US006062614A

United States Patent [19]

Petzold

[11] Patent Number: 6,062,614

[45] Date of Patent: May 16, 2000

[54] HANDLE FOR A CLOSING PART

[75] Inventor: Sven Petzold, Wiesbaden, Germany

[73] Assignee: Mannesmann VDO AG, Frankfurt, Germany

[21] Appl. No.: 09/120,978

[22] Filed: Jul. 22, 1998

[30] Foreign Application Priority Data

Jul. 25, 1997 [DE] Germany ..... 197 32 009

[51] Int. Cl.[7] ..... E05B 3/00

[52] U.S. Cl. ..... 292/336.3; 292/DIG. 31; 74/89.18; 74/543

[58] Field of Search ..... 16/115, 112; 74/89.18, 74/543; 292/336.3, DIG. 30, DIG. 31

[56] References Cited

U.S. PATENT DOCUMENTS

| | | | |
|---|---|---|---|
| 2,337,531 | 12/1943 | Stockton | 292/DIG. 31 X |
| 2,717,796 | 9/1955 | Cudney | 292/DIG. 31 X |
| 4,475,415 | 10/1984 | Yamamoto | 74/543 |
| 4,634,161 | 1/1987 | Fukasawa et al. | 292/336.3 |
| 4,778,207 | 10/1988 | Gergoe | 292/336.3 |
| 5,220,319 | 6/1993 | Kendel | 340/825.69 |
| 5,340,174 | 8/1994 | Bender et al. | 292/336.3 |
| 5,560,659 | 10/1996 | Dault . | |
| 5,600,302 | 2/1997 | Lewis | 340/457 |

FOREIGN PATENT DOCUMENTS

| | | |
|---|---|---|
| 0398106 | 11/1990 | European Pat. Off. . |
| 2243538 | 3/1974 | Germany . |
| 2854423 | 6/1980 | Germany . |
| 2936193 | 3/1981 | Germany . |
| 3625937 | 10/1987 | Germany . |
| 3818187 | 8/1989 | Germany . |
| 3835265 | 4/1990 | Germany . |
| 4305094 | 6/1994 | Germany . |
| 4331271 | 3/1995 | Germany . |
| 195 46 559 | 6/1997 | Germany . |
| 196 08 181 | 9/1997 | Germany . |

*Primary Examiner*—Teri Pham
*Attorney, Agent, or Firm*—Martin A. Farber

[57] ABSTRACT

A invention relates to a handle (2) for a closing part, especially a door, of a vehicle, with the handle (2) being located movably in a handle pocket (9). A movable cover plate (3) is associated with the handle (2), with the cover plate (3) is maximally covering the handle (2) in one position and releasing the handle (2) in another position.

12 Claims, 1 Drawing Sheet

HANDLE FOR A CLOSING PART

FIELD AND BACKGROUND OF THE INVENTION

The invention relates to a handle for a closing part, especially a door, of a vehicle, to the features of the respective preambles of the independent.

Such handles located for example externally on a door of the vehicle are known of themselves in vehicles. These handles are actuated by an operator to enter the vehicle, in order to open the door. Such handles however have the disadvantage that they are raised from the surface of the closing part (the door) and thus generate disturbing wind noises during travel. In addition, these projecting handles pose a risk of injury that is not insignificant. In addition these handles disturb the general appearance, since they break the flow of the body lines. Another disadvantage consists in the fact that these handles are subjected to the contaminations of the environment.

SUMMARY OF THE INVENTION

It is an object of the invention to provide a handle for a closing part, especially a door, of a vehicle, the handle, while maintaining the previous functions, avoiding the disadvantages named above and also taking safety and comfort aspects into account.

One solution according to the invention provides that a movable cover plate is associated with the handle, with the cover plate covering the handle as much as possible in one position and releasing the handle in another position. Because of the covering of the handle and the handle pocket, the handle itself and the handle pocket are effectively prevented from being contaminated, so that the operator has a clean handle available after the cover plate has been moved into a release position. Because of the covering of the handle and the handle pocket, these elements are covered as well, so that an outer door area that is as smooth as possible results, with air vortices effectively avoided and risk of injury excluded.

Another embodiment of the above named invention provides that a movable cover plate is associated with the handle, with the cover plate, in one position, maximally covering the area of the handle pocket that is not covered by the handle and exposing this area in another position. As a result, the entire handle pocket is sealed off by the surface of the handle and additionally by the surface of the cover plate, so that in this case also a smooth outer area results from which the advantages are provided. Following the movement of the cover plate from the position that covers the handle pocket into the position in which this area is exposed, the handle can be gripped from behind by the operator in the direction of the handle pocket, with this area being as free of contamination as possible because of its previous coverage by the cover plate.

Additional advantages of the solution according to the invention consist in the operation of the handle, namely a movement to unlock the door lock, is retained and not expanded by covering functions. As a result, the reliability is increased as well since the operations of the handle per se are not adversely affected. It is merely necessary to ensure that the cover plate in every case (even in the event of a power loss for example) can be brought into a position such that it can be actuated from the handle by the operator.

As a rule, handles are used that are pivotable, so that because of this pivoting, a transmission of this movement to the door lock takes place through Bowden cables, rods, or the like, and unlocks the door lock. It is also possible at this place for the movement of the handle to release an electrical pulse, with an actuator for actuating the door lock being controlled by this electrical pulse. It is also possible to have a combination of the two, so that in the normal case the electrical actuator performs the unlocking, but a mechanical connection between the handle and the door lock is also provided for redundancy.

In a further embodiment of the invention, the cover plate is movable by an actuator, especially an electrical actuator, from at least one position into another. In an especially advantageous manner, the cover plate is movable by the actuator from one position into the other and back again. Therefore, if a desire to open is signaled to the actuator, the actuator moves the cover plate from the covering position to the position, so that the handle can be operated. Following the operation (signaled for example by the successful unlocking process in the door lock or also possibly following the expiration of a certain time interval), the actuator returns the cover flap to its covering position. It is also possible to leave the cover flap in the covering position above a speed that can be determined in advance (walking speed for example) or to bring it into this covering position, while below this speed that can be set in advance or when the vehicle is at rest, the cover plate is moved into the position. This also has the advantage that when the vehicle is moving, the handle is inaccessible and thus opening of the door is prevented.

In a further embodiment of the invention, the actuator can be operated by remote control. Remote control for operating door locks including a central locking system are known of themselves. In this case it is proposed that simultaneously with the actuation of the central locking system by a remote control or also by an additional actuating desire, the actuator can be operated by remote control to move the cover plate from the covering position to the position. When the door has been opened and the operator has entered, the movement of the cover plate into its covering position takes place once more in an advantageous fashion after the door is closed.

In a further embodiment of the invention, the actuator can be manually overridden, which ensures that in the event of a power failure or another malfunction the cover plate can be brought into its position manually in order to actuate the handle. For example, electric motors, electromagnets, pneumatic drives, hydraulic drives, or the like can be used as actuators.

Further embodiments of the invention are shown in the dependent claims which illustrate additional advantageous effects.

BRIEF DESCRIPTION OF THE DRAWINGS

With the above and other objects and other advantages in view, the present invention will become more clearly understood in connection with the detailed description of the preferred embodiment, when considered with the accompanying drawing of which.

DETAILED DESCRIPTION OF THE PREFERRED EMBODIMENT

Figure 1:
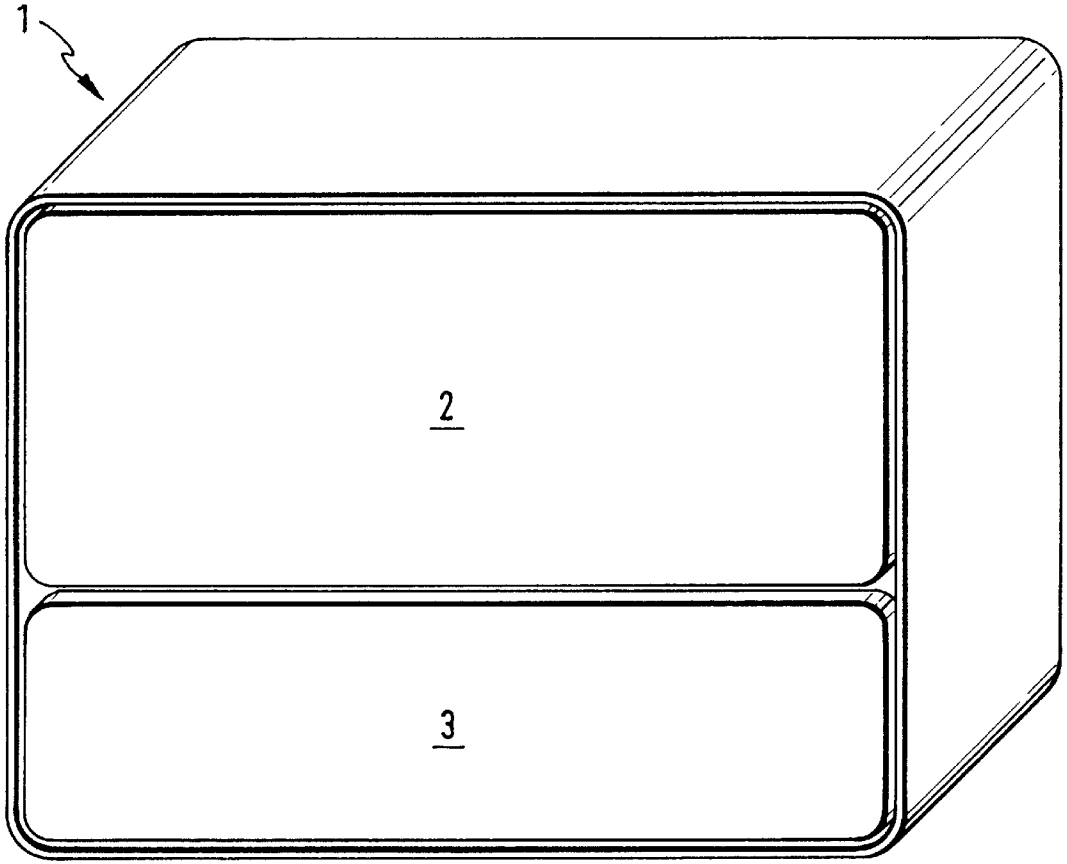
FIG. 1 shows a door module.

FIG. 1 shows a door module 1 in which a handle 2 and a cover plate 3 are located. This door module 1 for example is capable of being installed in a door of a vehicle, especially a side door, simplifying installation. Therefore, at least the actuator is also located in the door module 1. As is evident from FIG. 1, the handle 2 and the cover plate 3 form a maximally smooth and continuous surface, so that there are no projecting parts that could pose a risk of injury. Moreover, this smooth surface has the advantage that it is easier to clean. FIG. 1 shows that in the area surrounding the handle 2 and the cover plate 3 and at the door module 1 there is a gap, the tolerances of the parts being selectable such that this gap is vanishingly small, or that sealing means are provided in this gap.

Figure 2:
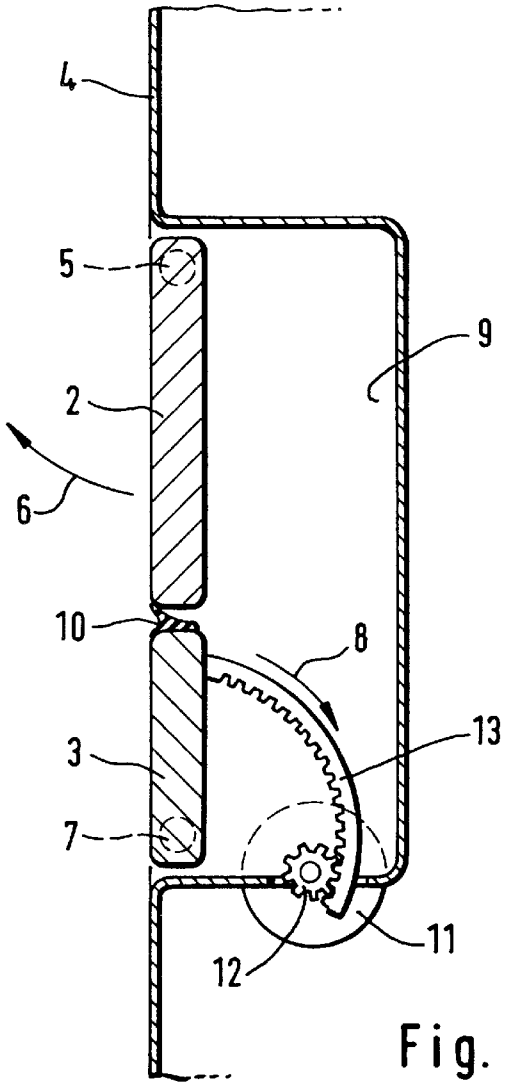
FIG. 2 shows a section through an embodiment according to the invention.

FIG. 2 shows a section through an embodiment according to the invention, with the handle 2 and the cover plate 3 in this case being located in a cutout in a door outer panel 4 of the vehicle. The handle 2 is pivotable around a pivot 5 from its resting position shown in FIG. 2 in a pivoting direction 6 to actuate the door lock. In a similar formation, the cover plate 3 is also pivotable around a pivot 7 in a pivoting direction 8. FIG. 2 shows that the pivoting direction 6 is outward away from, and the pivoting direction 8 is inward toward, a handle pocket 9. It is also possible here for the pivoting directions 6 and 8 to be in the same direction (outward for example), so that linear movements of the handle 2 and/or the cover plate 3 with consideration of FIG. 2 are possible, to the left or right and/or up and/or down. A seal is indicated by reference number 10, the seal being located on the cover plate 3 and sealing the gap between the handle 2 and the cover plate 3. The seal 10 of course can also be located on the handle 2.

An electric motor 11 is shown as the actuator, the motor having on its shaft, not shown in greater detail, a drive pinion 12, with drive pinion 12 meshing with an arcuate (or straight) rack 13, with the rack 13 being connected with the cover plate 3. By means of the electric motor 11, the cover plate 3 is moved in the pivoting direction 8 or opposite the pivoting direction 8 from its covering position shown in the figure into the release position and back again, so that in the release position of the cover plate 3, the handle 2 can be gripped from behind, with no contamination, by the operator. The electric motor 11 is either controlled for periods of time that can be set in advance, during which the cover plate 3 can reach the other position in each case, and it is also possible that switches are provided in the end positions that switch off the electric motor 11 after an end position is reached. Instead of the end position switches, a parameter (especially the current consumption) can also be measured, since this parameter changes significantly when an end position is reached, and this can be used as a measurement for the switching off. Instead of the reduction gearing, consisting of drive pinion 12 and rack 13, other construction forms (a worm drive for example) can be used, with a reduction not being absolutely necessary to be provided, so that direct drives (a plunger movable linearly by an electromagnet for example the plunger, fastened with articulation to the cover plate 3) are possible. In selecting the actuator, especially in selecting the reduction gearing, assurance must be provided that this can be manually overridden, so that in the event of a malfunction (especially a power failure), the cover plate 3 can be moved manually in the pivot direction 8 in order to be able to perform the function of the handle 2.

List of Reference Numbers

1. door module
2. handle
3. cover plate
4. door outer panel
5. pivot
6. pivoting direction
7. pivot
8. pivoting direction
9. handle pocket
10. seal
11. electric motor
12. drive pinion
13. rack

I claim:

1. Handle unit for a closing part of a vehicle, with a handle being movably located in a handle pocket, further comprising a movable cover plate associated with the handle, the cover plate maximally covering the handle in one position and exposing the handle in a second position, an actuator comprising an electric motor with a drive pinion, the cover plate being movable by said actuator from at least one position into another position, a rack connected with the cover plate, wherein the drive pinion meshes with said rack for moving the cover plate from said at least one position to said another position.

2. Handle unit according to claim 1, wherein the cover plate is movable by the actuator from said at least one position into said another position and back again.

3. Handle unit according to claim 1, wherein the actuator can be operated by remote control.

4. Handle unit according to claim 1, wherein the actuator can be manually overriden.

5. Handle unit according to claim 1, further comprising a seal provided at least between the handle and the cover plate.

6. Handle unit according to claim 1, wherein said closing part is a door.

7. Handle unit for a closing part of a vehicle, with a handle being located movable in a handle pocket, further comprising a movable cover plate associated with the handle, the cover plate, in one position, maximally covering an area of the handle pocket that is not covered by the handle and exposing this area in a second position, an actuator comprising an electric motor with a drive pinion, the cover plate being movable by said actuator from at least one position into another position, a rack connected with the cover plate, wherein the drive pinion meshes with said rack for moving the cover plate from said at least one position to said another position.

8. Handle unit according to claim 7, wherein the cover plate is movable by the actuator from said at least one position into said another position and back again.

9. Handle unit according to claim 7, wherein the actuator can be operated by remote control.

10. Handle unit according to claim 7, wherein the actuator can be manually overriden.

11. Handle unit according to claim 7, further comprising a seal provided at least between the handle and the cover plate.

12. Handle unit according to claim 7, wherein said closing part is a door.

* * * * *